United States Patent [19]

Hollesen

[11] Patent Number: 4,904,020

[45] Date of Patent: Feb. 27, 1990

[54] CHAIR COMPRISING A SEAT, A BACK AND A FRAME

[75] Inventor: Sven A. Hollesen Basse, Rungsted Kyst, Denmark

[73] Assignee: Danaction Consult-Invest A/S, Rungsted Kyst, Denmark

[21] Appl. No.: 238,343

[22] PCT Filed: Jan. 7, 1988

[86] PCT No.: PCT/DK88/00002

§ 371 Date: Aug. 26, 1988

§ 102(e) Date: Aug. 26, 1988

[87] PCT Pub. No.: WO88/04902

PCT Pub. Date: Jul. 14, 1988

[51] Int. Cl.[4] ..... A47C 1/02

[52] U.S. Cl. ..... 297/317; 297/322; 297/343

[58] Field of Search ..... 297/317, 318, 322, 343

[56] References Cited

U.S. PATENT DOCUMENTS

| | | | |
|---|---|---|---|
| Re. 29,483 | 11/1977 | Re | 297/318 |
| 677,234 | 6/1901 | Kelly | 297/343 |
| 2,953,103 | 9/1960 | Bohannon et al. | 297/318 |
| 3,567,280 | 3/1971 | Bradshaw . | |
| 3,572,829 | 3/1971 | Malitte . | |

FOREIGN PATENT DOCUMENTS

| | | | |
|---|---|---|---|
| 1099705 | 2/1961 | Fed. Rep. of Germany . | |
| 3033953 | 2/1985 | Fed. Rep. of Germany . | |
| 1549041 | 7/1979 | United Kingdom | 297/322 |

*Primary Examiner*—Francis K. Zugel

*Attorney, Agent, or Firm*—Watson, Cole, Grindle & Watson

[57] ABSTRACT

A chair comprises a seat (6), a back (7) and a frame (2, 3, 4, 5). In order to give the user a comfortable opportunity to change his position during the use of the chair, the positions of both the chair (6) and the back (7) are readjustable with respect to the frame. The angular position of the seat is readjustable from a first position to a more backward inclined position and the back (7) is readjustable from a first position to a more backwardly inclined position. The back (7) is during the readjustment lowerable with respect to the seat (6) in order to avoid movements between the body and the clothes of the user during the readjustment of the chair.

1 Claim, 5 Drawing Sheets

BEST AVAILABLE COr

CHAIR COMPRISING A SEAT, A BACK AND A FRAME

Figure 1:
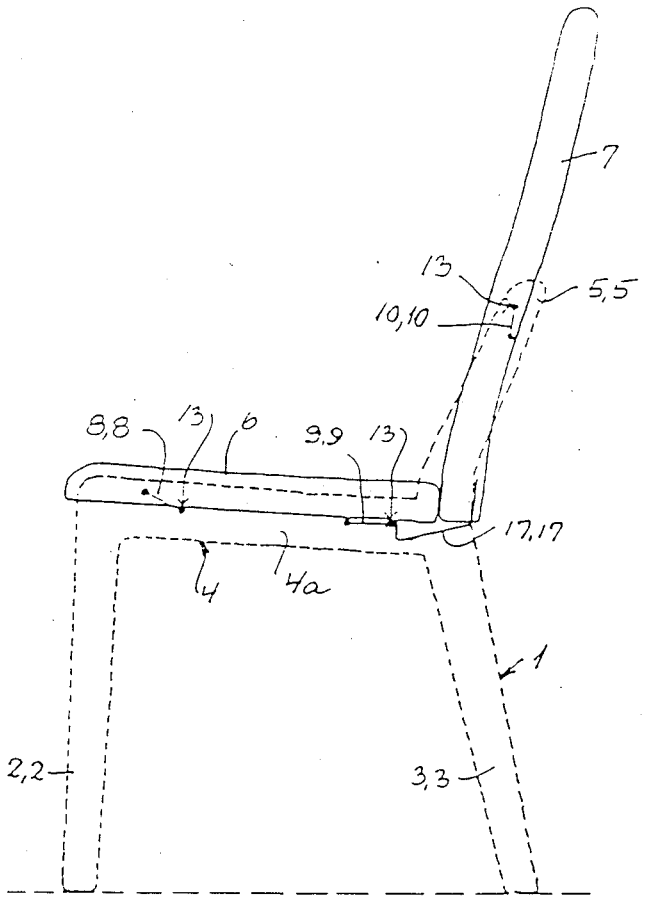

The present invention relates to a chair comprising a seat, a back and a frame, wherein the angular position of the seat with respect to the frame is readjustable from a first position to a more rearwardly inclined second position, and wherein the angular position of the back with respect to the frame is readjustable from a first position to a more rearwardly inclined second position whereby the seat and the back in their said second positions form an angle with each other which is greater than the angle which they form with each other in their first positions, the seat and the back being mutually hinged.

A chair of the kind referred to above is known from DE patent specification published for opposition No. 10 99 705. According to this prior art the seat and the back are mutually hinged by means of hinge connections arranged at the lower edge of the back and behind the rear edge of the seat. By the readjustment from the first to the second position the hinge connections between the back and the seat are moved downwardly along an obliquely downwardly and forwardly inclined guideway and thereby the seat is moved forwardly and the front edge of the seat is pivoted upwardly by means of two oblique guideways. Simultaneously, the lower edge of the back is pivoted forwardly with respect to a pair of slide shoes sliding in generally vertical guideways at the lower edge of the back. The chair known from said publication is a pronounced easy and resting chair, which is readjusted only occasionally.

By udsing a chair during a long time, e.g. in connection with time consuming conferences and diner parties the person using the chair may feel dislike of occupying the same sitting position constantly. However, if the readjustability known from said DE specification No. 10 99 705 is used in connection with a conference chair or dining room chair of the kind where the user may be assumed to shift position comparatively often it has been proven that the readjustability from a less to a greater angle between the back and the seat and back again results in a drawback for the person using the chair, viz. that the clothes of the person is moved with respect to the body, and it is the object of the present invention to avoid this drawback and this object is according to the invention achieved in that the back in its said second position occupies a lower position with respect to the seat than in its said first position. Hereby a compensation, at least partly, is achieved as regard the increased distance between the centre of the seat and the centre of the back, which otherwise would result from the increased angle between the seat and the back in their said second positions because the lowering of the back with respect to the seat will result in that the distance between said centres will not change considerably during the readjustment, and accordingly also the clothes of the person in question will not be moved in an unpleasant way.

Due to the fact that the present invention primarily is directed towards a conference chair or dining room chair an embodiment is according to the present invention preferred whereby the seat in its first position is generally horizontal or inclined slightly backwardly, whereas the back in its first position is generally vertical or inclines slightly rearwardly.

In order to achieve a particularly pleasant position of rest, i.e. the position wherein the back and the seat occupy their said second positions, a preferred embodiment for the present invention is proposed which is characterized in that the angle, through which the back is readjustable, is greater than the angle through which the seat is readjustable.

In order to achieve the lower height of the back with respect to the seat in the second positions of the seat and the back, the hinge connection between the back and the seat may according to an appropriate embodiment of the invention be positioned a distance in front of the rear end of the seat.

In order to achieve a mounting of the back and the seat in the frame of the chair which in a simple way allows the readjustment here concerned an embodiment is according to the present invention proposed which is characterized in that the seat is guided with respect to the frame by means of a foremost and a rearmost pair of guideways, of which the formost pair extends obliquely from behind and upwardly and the rearmost pair extends generally horizontally, and in that the back is guided with respect to the frame by means of a pair of guideways extending generally vertically.

In order to achieve a positioning of the hinge connection between the back and the seat at a distance in front of the rear end of the seat the hinge connection between the back and the seat may appropriately according to the present invention be constituted by two hinges each comprising a hinge part with a first rod part secured to the lower edge of the back, another rod part extending forwardly with respect to the back and terminated by a bearing part, said bearing part engaging a pin for a slide shoe for the corresponding rearmost guideway for the seat.

Figure 2:
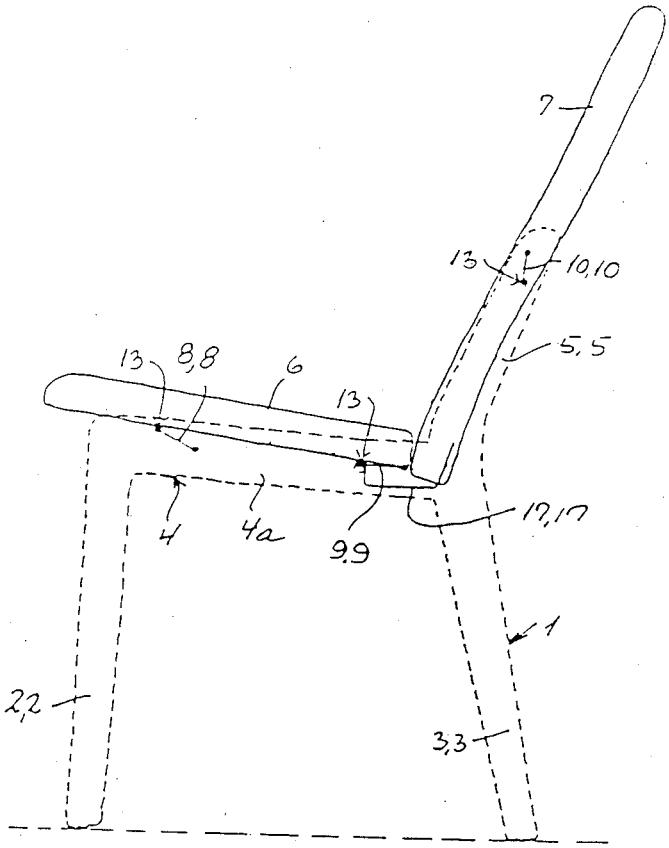

Hereinafter the present invention will be further explained with reference to the drawing, on which FIG. 1 schematically shows an embodiment of the chair according to the present invention in a first or initial position, FIG. 2 shows the chair shown in FIG. 1, also schematically and in its readjusted position, FIG. 3 on an increased scale shows a part of the chair in the position shown in FIG. 1, FIG. 4 on an increased scale shows a part of the chair in the position shown in FIG. 2, FIG. 5 a part of a view from below of the part of the chair shown in FIG. 3, and FIG. 6 a guideway for the chair shown.

On the drawing, 1 is the frame of the chair which for the sake of clarity is shown in dotted lines. The frame consists of two front legs 2,2 and two rear legs 3,3 and a rectangular frame 4. Moreover, the frame comprises two upstanding supports 5,5. According to the embodiment shown on the drawing the frame is divided into two side parts, each comprising a front leg 2, a rear leg 3, a frame part **4*a* connecting the legs, and a support 5, which parts all extend generally in the same plane. The side parts are mutually connected by means of frame parts not shown completing the frame 4**.

The chair is provided with a seat 6 and a back 7. The seat 6 is supported with respect to the frame by means of a foremost pair of guideways 8,8 and a rearmost pair of guideways 9,9. The back 7 is supported with respect to the frame by means of a pair of guideways 10,10. It will be understood that one guideway of each pair of guideways is positioned at one side of the chair, whereas the other guideway is positioned along the other side of the chair.

Figure 6:
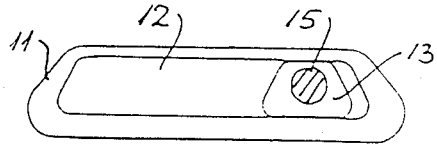

A guideway is shown separately in FIG. 6 and comprises an insert 11 of plastic, wherein a guideway groove 12 is provided for accomodating a slide shoe 13. As shown the slide shoe 13 generally has the shape of a rhomb having rounded corners, and the ends of the guideway groove 12 are shaped for abutment against the side surfaces of the slide shoe.

According to the embodiment shown on the drawing the inserts 11 of the guideways are inserted into the side parts of the frame in such away that the inserts 11 belonging to each pair are arranged with their guideway grooves facing each other. Accordingly, the guideway inserts for the guideways 8 and 9 are inserted into the frame parts 4 and the inserts for the guideways 10,10 are inserted into the supports 5,5. The corresponding slide shoes are connected with the sides of the seat 6 and the back 7, respectively, and each of the slide shoes are pivotably arranged on a pin 15, cf. FIG. 6, which, accordingly, are secured to the seat and the back, respectively.

Figure 3:
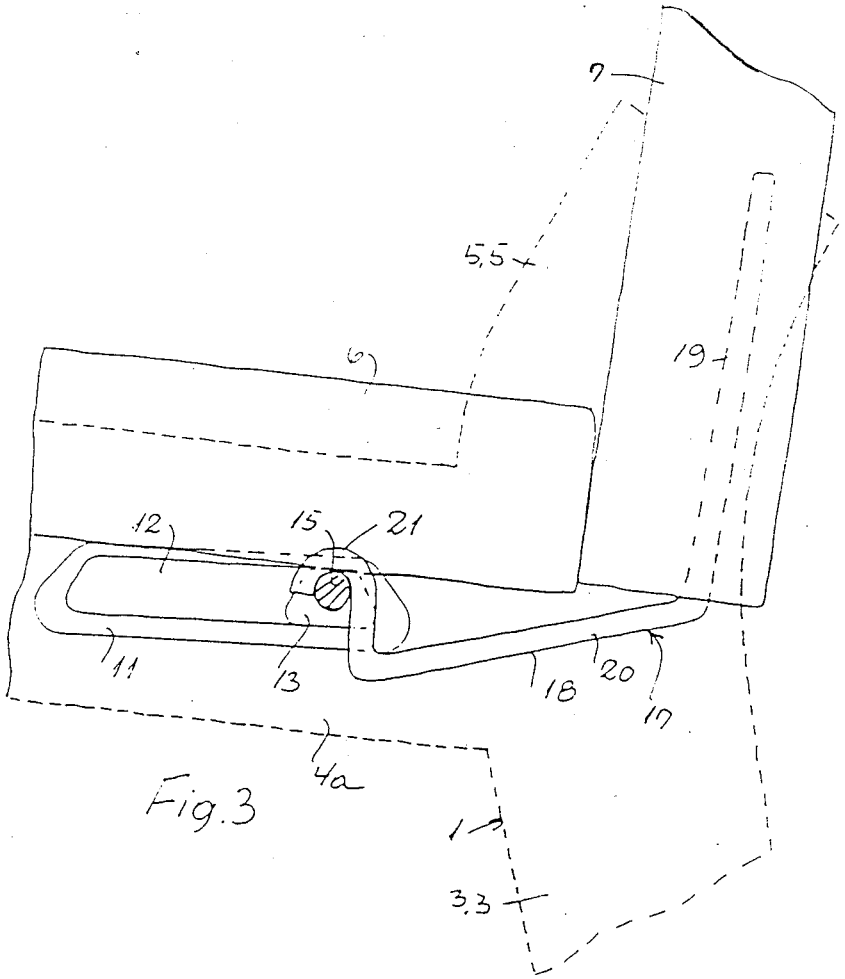
Figure 4:
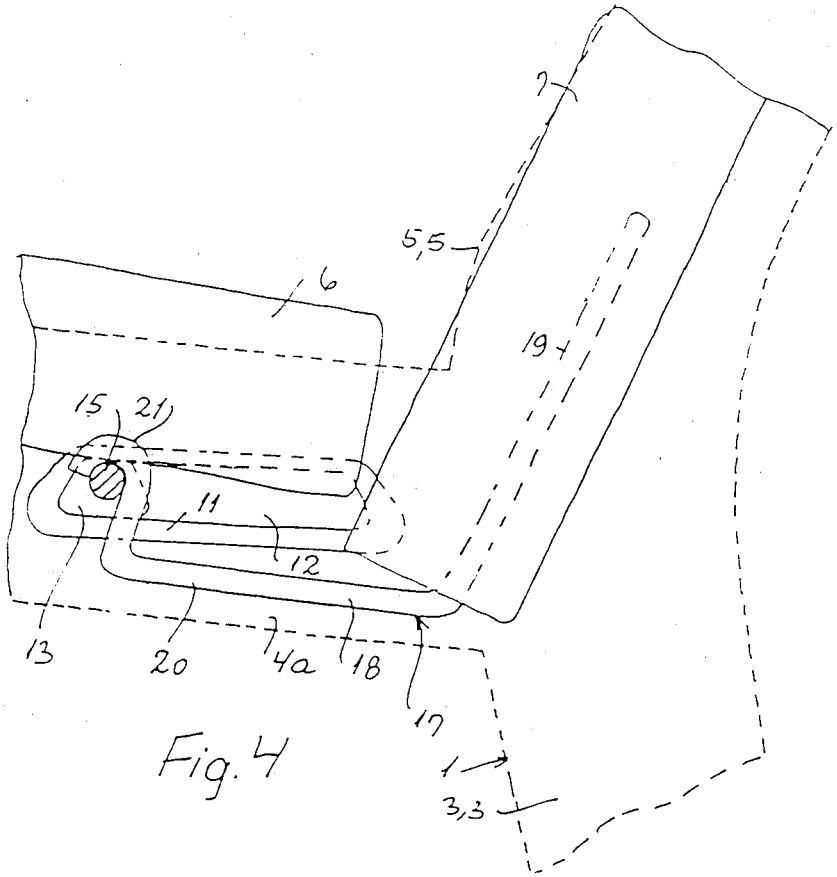
Figure 5:
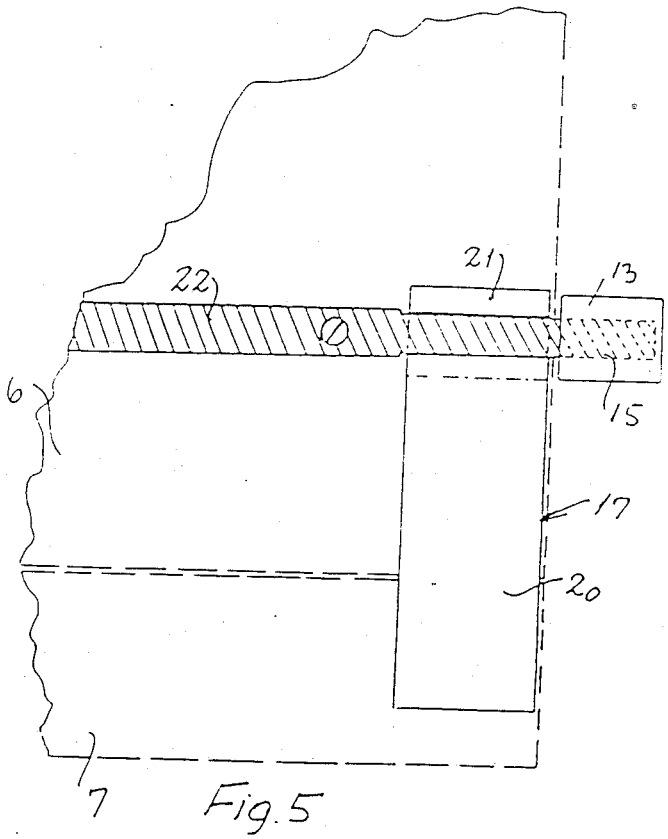

The seat 6 and the back 7 are mutually connected by means of two hinge connections 17,17 shown very schematically on FIGS. 1 and 2, but which are shown more detailed on FIGS. 3, 4 and 5. Each hinge connection consists of a hinge part 18 bent from a length of bar iron one end 19 of which is secured within the back 7. The rod part 19 continues in a second rod part 20 forming an obtuse angle with respect to the rod part 19, and which terminates in a bearing part which according to the embodiment shown is constituted by a hook part 21, the opening of which faces downwardly. Due to the rod part 20 the hook part 21, accordingly, will be positioned at a distance in front of the back 7. In the mounted position of the chair the two hook parts 21 of the two hinge parts 18 engage with the pins 15 for the slide shoes 13 for the rearmost pair of guideways for the seat. This appears clearly from FIG. 4, which shows the rod part 20 seen from below and the hook part 21, also seen from below, and wherein the corresponding slide shoe 13 and its pin 15 simultaneously are shown. In order to move the hook parts 21 into engagement with the corresponding pins appropriate recesses are provided in the lower surface of the seat. The pins 15 for the rearmost pair of guideways of the seat are constituted by the ends of a rod 22 which as it appears from FIG. 5 is secured to the lower surface of the seat. Due to the downwardly open hook parts 21 the hook parts will maintain the back 7 lifted in the position shown on FIG. 1.

As it appears from FIGS. 1 and 2 the foremost pair of guideways 8,8 are positioned inclined forwardly and upwardly, whereas the rearmost pair of guideways 9,9 for the seat extends generally horizontally. The pair of guideways 10,10 secured in the supports 5,5 extends generally vertically.

The chair shown on the drawing is intended as chair to be used during conferences or e.g. as dining room chair, viz. a chair to be used a comparatively long time by the user. This is tiresome and, accordingly, the chair has the readjustability indicated in FIGS. 1 and 2. By comparing FIGS. 1 and 2 it will be seen that the seat in its first position or initial position, FIG. 1, extends generally horizontally or slightly inclined backwardly, whereas the back 7 extends generally vertically or inclined rearwardly. In the readjusted position the seat extends with an increased rearward inclination, and the same is the case as regards the back. Simultaneously, the angle between the seat and the back is greater in the position shown on FIG. 2 than in the position shown on FIG. 1. The readjustment is carried out by the person using the chair, who pushes his buttocks forwardly and leans his back further rearwardly. Due to the orientation of the guideways the seats will be transferred from the position shown on FIG. 1 to the position shown on FIG. 2, and the back will be transferred from the position shown on FIG. 1 to the position shown on FIG. 2. The grooves of the guideways and the orientation of the grooves are determined so that the corresponding slide shoes from being in abutment against one end of the grooves of the guideways abut against the other end of the grooves. If the seat and the back were mutually hinged immediately at the rear edge of the seat and the lower edge of the back, the increased angle position between the seat and the back in the readjusted position would result in a movement of the users clothes with respect to his body due to the increased distance between e.g. the location where the buttocks of the person in question rest upon the seat 6 and the location where the back of the person in question rests against the back 7, caused by the increased angle between the seat and the back. However, a compensation for such movement is achieved due to the hinge arrangement explained above between the back and the seat, viz. in such a way that the hook part 21 and, accordingly, the centre of pivot between the seat and the back is offset forwardly with respect to the rear end of the seat. When readjustment occurs the back will carry out both a pivoting movement and a movement downwardly with respect to the seat which appears from comparing FIGS. 3 and 4, from which it will be seen that the lower edge of the back has moved downwardly with respect to the lower surface of the seat. Thereby at least a considerable compensation is achieved as regards the movement between the body and the clothes of the person in question as explained above.

According to the embodiment shown on the drawing the foremost pair of guideways 8,8 of the seat is arranged extending inclined downwardly as seen from the front and rearwardly under an angle of approximately 25° with respect to the horizontal direction in the position of use of the chair. However, this angle may vary e.g. between approximately 20° and approximately 30°. The rearmost pair of guideways 9,9 of the seat is as mentioned above generally horizontally, but may have an inclination of ±5°. According to the embodiment shown the guideways for the seat have a length of stroke of approximately 4.5 cm, however, may vary e.g. ±1 cm. The pair of guideways 10,10 for the back extends according to the embodiment shown inclined upwardly and rearwardly under an angle of approximately 10° with respect to vertical direction. This angle can also varies e.g. between 0° and 20°. The pair of guideways 10,10 for the back has a length of stroke which is a little less than the length of stroke of the pairs of guideways of the seat, seeing that the length of the stroke of the pair of guideways 10,10 is approximately 3 cm. However, this length of stroke may also vary e.g. ±1 cm.

I claim:

1. Chair comprising a seat and a back and a frame, wherein said seat is guided with respect to the frame by means of a foremost pair of guideways and a rearmost pair of guideways into which pins connected with the seat extend, and wherein said back is guided with respect to the frame by a pair of guideways into which pins connected with said back extend, all of said guideways having a shape such that the angular position of the seat with respect to the frame is readjustable from a first position to a more rearwardly inclined second position, and that the angular position of the back with respect to the frame is readjustable from a first position and to a more rearwardly inclined second position, whereby said seat and said back in their said second positions form an angle with each other which is greater than the angle which they form with each other in their said first positions, and wherein said back is pivotally connected with the seat at a distance from the rear edge of said seat; wherein said pivot connection between said back and said seat comprises rigid hinge parts, one end of which being fixedly extending forwardly connected with said back and below said seat and the other end of which being pivotally connected with said seat forwardly of the rear edge, said hinge parts, adapted so as to maintain said back lifted in said first position of said back, each of said guideways comprising an insert with a guiding groove for receiving said seat and back pins, said inserts being inserted into said frame with the guiding grooves of the inserts of each pair of guideways facing each other.

* * * * *